US005979712A

United States Patent [19]

Montaner et al.

[11] Patent Number: 5,979,712

[45] Date of Patent: Nov. 9, 1999

[54] UPRIGHT/INVERTED SPRAYER

[75] Inventors: Pedro Parés Montaner, Esplugues Barcelona; Lluis Costa Quintas, Barcelona, both of Spain

[73] Assignee: Monturas, S.A., Barcelona, Spain

[21] Appl. No.: 09/170,219

[22] Filed: Oct. 13, 1998

[30] Foreign Application Priority Data

Oct. 24, 1997 [ES] Spain ..... 9702196

[51] Int. Cl.[6] ..... B05E 9/043

[52] U.S. Cl. ..... 222/321.4; 222/376; 222/402.19; 239/342

[58] Field of Search ..... 222/321.4, 321.7, 222/321.9, 376, 385, 402.19; 239/333, 342

[56] References Cited

U.S. PATENT DOCUMENTS 4,277,001 7/1981 Nozawa .

4,371,098 2/1983 Nozawa et al. ..... 222/321.4

4,776,498 10/1988 Maerte et al. ..... 222/402.19

5,064,105 11/1991 Montaner .

*Primary Examiner*—Steven O. Douglas

*Attorney, Agent, or Firm*—Watson Cole Grindle Watson, P.L.L.C.

[57] ABSTRACT

A manually actuated liquid pump sprayer, capable of being operated in both an upright position and in an inverted position, includes an adapter attached to its pump body to effect the upright and inverted spray, the adapter having first and second fluid passages extending from an adapter chamber in opposite directions for respectively inletting liquid from the container to the chamber in one of the upright and inverted positions, and being exposed to air in the container in the other such positions, the passages terminating within the chamber in opposing upright and inverted valve seats which are valved controlled by a single gravity shifting ball check valve.

5 Claims, 4 Drawing Sheets

UPRIGHT/INVERTED SPRAYER

BACKGROUND OF THE INVENTION

This invention relates to a manually actuated liquid pump sprayer capable of being operating in both an upright position and in an inverted position by the provision of first and second oppositely extending fluid flow passages extending within the liquid in the container to which the pump sprayer is mounted in one of the upright and inverted positions, and extending into air in the container and the other of such positions.

Pump dispensers having only a single fluid flow passage comprising a dip tube extend from the pump into the liquid at the bottom of the container such that liquid is suctioned into the pump sprayer during its operation so long as there is liquid in the container and while the container is held in a position in which its bottom is located substantially below the pump sprayer.

Such known dispensers, however, are generally incapable of being operated in an inverted position as when the dip tube is no longer in communication with the liquid in the container.

U.S. Pat. No. 4,277,001 discloses a manually actuated pump sprayer adapted for upright and inverted spray by the provision of a three-way valve assembly mounted to the sprayer. Such assembly is, however, of complex structure requiring ball check valves associated with both oppositely extending fluid flow passages.

SUMMARY OF THE INVENTION

It is an object of the present invention to provide a pump sprayer capable of upright and inverted spray by the provision of an adapter which is of simple construction, is highly economical and avoids the known disadvantages of the prior art. According to the invention the adapter has confronting upright and inverted valve seats located within an adapter chamber in communication with the pumping mechanism, there being a single gravity shifting ball check valve provided for both valve seats.

The adapter for the manually actuated pump sprayer according to the invention is a two-part structure comprising an elongated liner mounted to the pump body of the sprayer, and a hollow insert element coupled to the liner and extending into a terminal end of the liner. The liner has an inner elongated coaxial cylinder which defines an adapter chamber and which is coupled to a valve controlled inlet passage of the pump body. A first of the valve seats projects into the adapter chamber from a wall of the cylinder. The insert element supports a second of the valve seats which projects into the adapter chamber.

Further according to the invention the liner of the two-part adapter has an internal longitudinal first groove which forms a portion of the second passage together with the pump body. The insert element has an external longitudinal second groove which forms another portion of the second passage together with the liner, and the cylinder has an external longitudinal third groove which forms a portion of the first passage together with the insert element.

Other objects, advantages, and novel features of the invention will become more apparent from the following detailed description of the invention when taken in conjunction with the accompanying drawings.

DETAILED DESCRIPTION OF THE INVENTION

Figure 1:
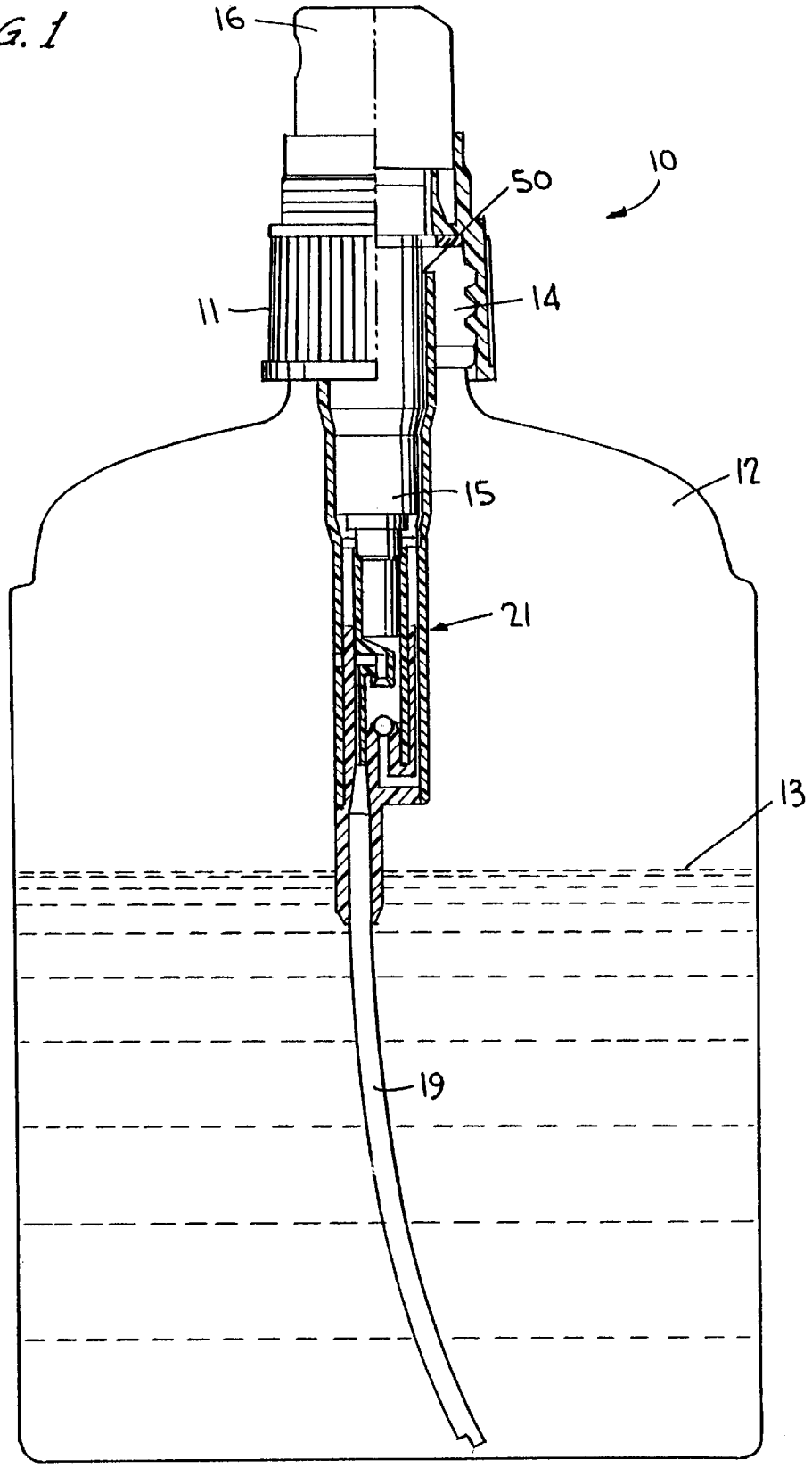
FIG. 1 is a side elevational view, partly in section, of the upright/inverted adapter according to the invention attached to a manually actuated pump sprayer mounted on a container of liquid shown in an upright position.

A manually actuated pump sprayer of any known type, such as the finger actuated pump disclosed in U.S. Pat. No. 5,064,105 commonly owned herewith, is generally designated 10 in FIG. 1 has an internally threaded closure cap 11 to facilitate mounting the pump sprayer to a container 12 of liquid 13 to be dispensed. The pump sprayer mounted to an externally threaded neck 14 of the container, further includes a pump body 15 which extends into the container interior, and a dispenser head 16 having a discharge orifice (not shown) through which liquid product is sprayed upon depression of the head usually by the finger of the user for actuating the pumping mechanism, as disclosed in the aforementioned patent. Other fingertip sprayers are capable of being utilized together with the adapter according to the invention.

Figure 2:
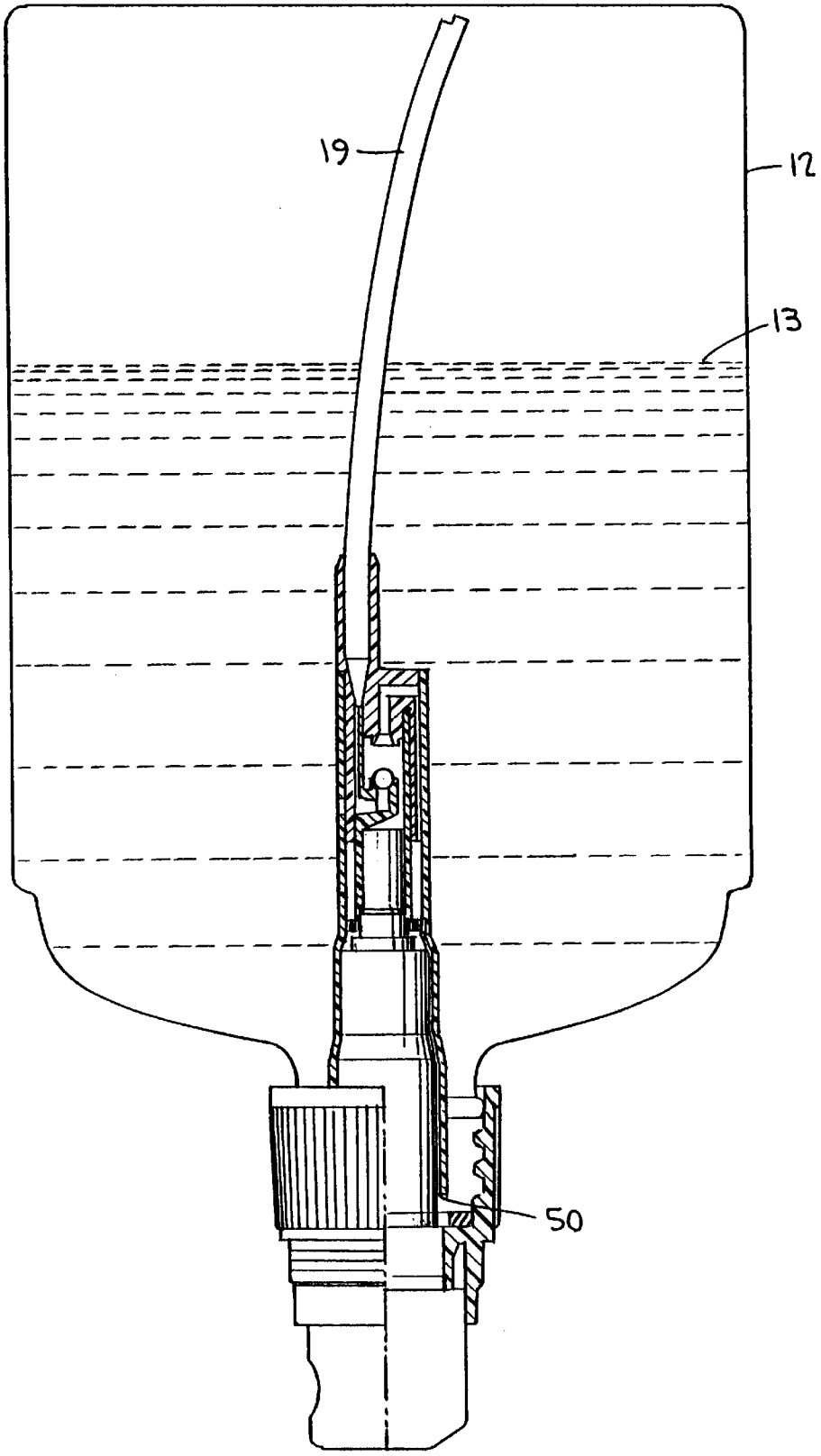
FIG. 2 is a view similar to FIG. 1 showing the container and pump in an inverted position.
Figure 3:
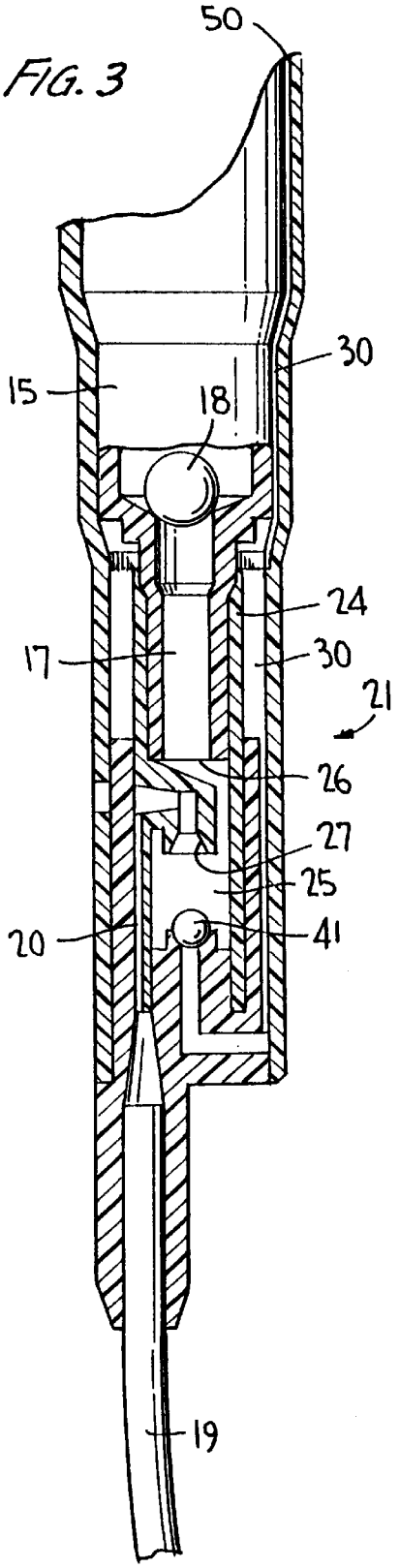
FIG. 3 is a vertical sectional view of the adapter according to the invention shown mounted to the pump body in an upright position.
Figure 4:
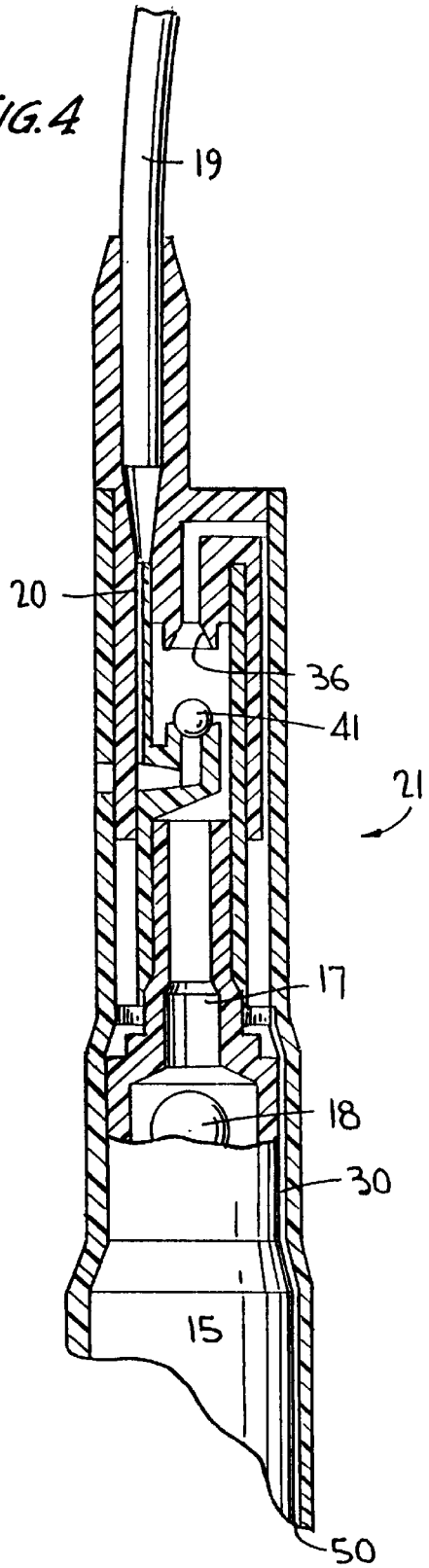
FIG. 4 is a view similar to FIG. 3 in the inverted position.

As more clearly shown in FIGS. 3 and 4, the terminal end of the pump body which extends into the container forms an inlet passage 17, as is typical for fingertip pump sprayers of this type, which is valve controlled by, for example, a ball check valve 18 although other inlet valving may be provided. A dip tube, such as 19, would normally depend directly from inlet passage 17 except that, in accordance with the invention, the dip tube extends from an upright/inverted adapter provided according to the invention, generally designated 21. The adapter comprises a two-part structure shown in detail in FIGS. 5 and 7, and is shown assembled together in FIGS. 1 to 4.

Figure 5:
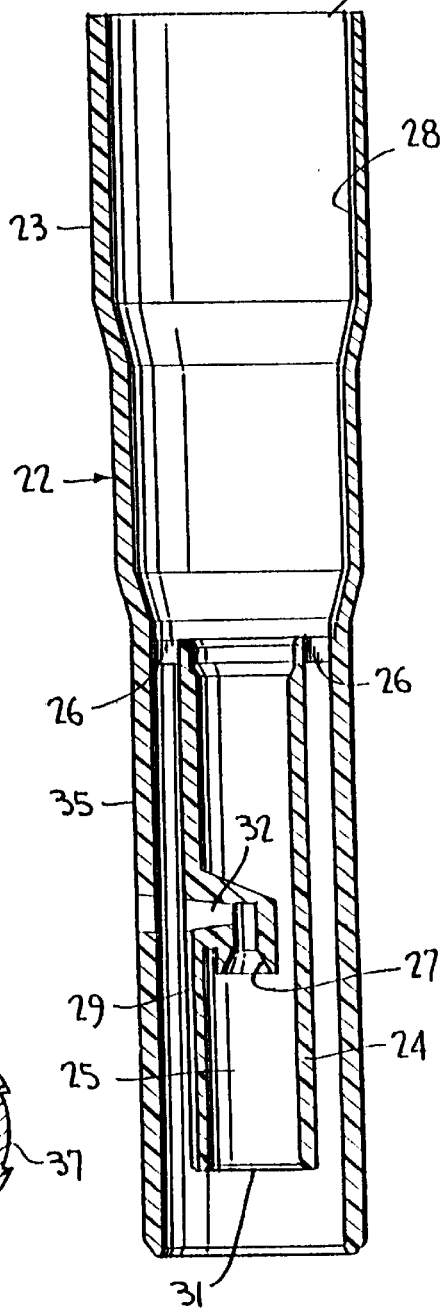
FIG. 5 is a vertical sectional view of the elongated liner forming one part of the adapter according to the invention.
Figure 6:
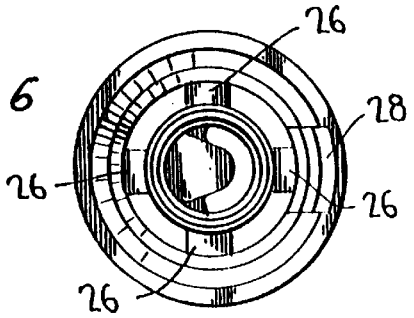
FIG. 6 is a top plan view of the liner of FIG. 5.

Turning to FIG. 5 an elongated liner generally designated 22 is shown as forming one part of the adapter, the liner having a first section 23 of a shape complementary to that of pump body 15 such that the liner can be conveniently attached thereto and be secured by a friction fit. The liner has an internal cylinder 24 which defines an adapter chamber 25, the cylinder being mounted within the liner as by a plurality of spaced radial arms 26 more clearly shown in FIG. 6. And as shown in FIG. 3 the cylinder is telescoped over sleeve 26 of the pump body, such that adapter chamber 25 communicates with inlet passage 17 of the pump.

As shown in FIGS. 1 to 4, the adapter comprises a pair of confronting, upright and inverted valve seats, a first valve seat 27 being shown in FIG. 5 as projecting into adapter chamber 25 from a wall of cylinder 24.

First section 23 of liner 22 has an internal longitudinal first groove 28 which together with pump body 15 forms a portion of a second fluid flow passage extending into the adapter chamber which will be described more fully hereinafter. And, cylinder 24 has an external longitudinal third groove 29 extending between free end 31 of cylinder 24 and a transverse port 32 leading to valve seat 27.

Figure 7:
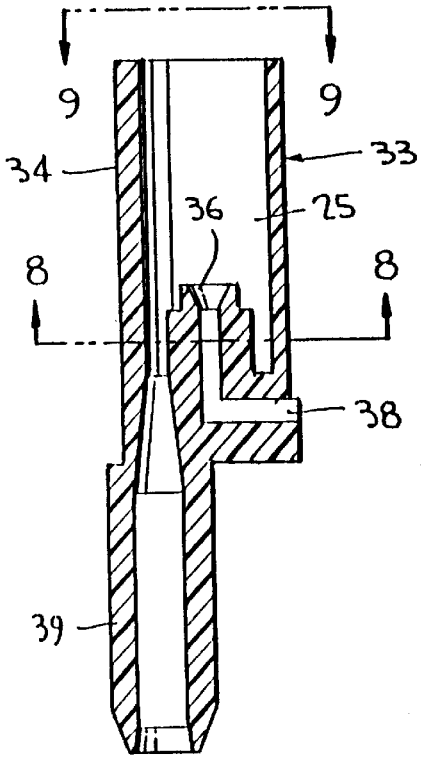
FIG. 7 is a vertical sectional view of the other part of the adapter of the invention in the form of a hollow insert element.
Figure 9:
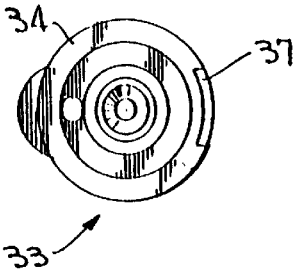
FIG. 9 is a top elevational view of the insert element of FIG. 7.
Figure 8:
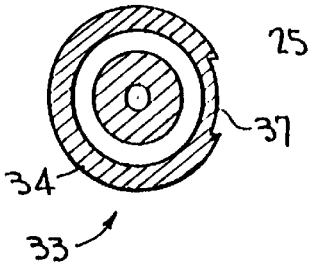
FIG. 8 is a cross-sectional view taken substantially along the line 8—8 of FIG. 7.

The second part of the adapter according to the invention comprises a hollow insert element generally designated 33 in FIGS. 7, 8 and 9. The insert element has a first cylindrical section 34 which extends into second section 35 of liner 22 so as to be frictionally coupled together with the liner as shown in FIGS. 3 and 4. First section 34 of the insert element supports a second of the valve seats 36 which projects into adapter chamber 25.

First section 34 of insert element 33 has an external longitudinal second groove 37 more clearly shown in FIGS. 8 and 9, the groove forming a second fluid flow passage 30 together with the liner when assembled. Second groove 37 extends from the terminal end of portion 34 to port 38 which communicates with valve seat 36. The insert element further has an external sleeve 39 into which one end of dip tube 19 is fitted for suspending the dip tube inside the container.

When parts 22 and 33 are assembled together groove 29 forms together with portion 34 of the insert element a portion of first fluid flow passage 20 which is in communication with the interior of the dip tube.

In operation, with the pump and container in a substantially upright position as shown in FIGS. 1 and 3, product is suctioned into the pump chamber of the pump (not shown but downstream of valve 18) during pumping operation as product is suctioned up the dip tube and into adapter chamber 25 and up through inlet passage 17. A single ball check valve 41 has gravity shifted between the confronting valve seats 27 and 36 such that in the upright position valve 41 is seated at its valve seat 36 for valving second fluid flow passage 30 closed. Thus although the second fluid passage is in communication with the air inside the container, as the passage terminates at 50 in the vicinity of container closure 11, air is prevented from being suctioned into adapter chamber 25 during the pump suction strokes. While in the upright position the pump operates in a normal manner as a standard pump.

With the pump in a substantially inverted position shown in FIGS. 2 and 4, the dip tube and its fluid flow passage 20 now communicate with the air in the container, while the second fluid flow passage 30 is in communication with the liquid in the container. The ball check valve 41 falls by gravity to its seat 27 to thereby valve air passage 20 closed while product is suctioned into the pump chamber via the adapter chamber through passage 30 to facilitate carrying out the pumping operation as in any normal manner.

From the foregoing it can be seen that a simple and economical yet highly effective adapter for a manually actuated pump dispenser has been devised which renders the dispenser capable of both upright and inverted spray without leakage and without the need for a complex valving assembly. Moreover the two parts of the adapter can each be molded easily and economically by known plastic molding techniques.

Obviously many modifications and variations of the invention are made possible in the light of the above teachings. It is therefore to be understood that within the scope of the appended claims the invention may be practiced otherwise than as specifically described.

What is claimed is:

1. A manually actuated liquid pump sprayer capable of being operated in both an upright position and in an inverted position, comprising a pump body having means for mounting the body to a container of liquid to be dispensed, adapter means mounted to said body for effecting both upright and inverted spray, said adapter means having first and second fluid passages extending from an adapter chamber in opposite directions for respectively inletting liquid from the container to the chamber in only one of the upright and inverted positions, and being exposed to air in the container in the other of said positions, said passages terminating within said chamber in opposing upright and inverted valve seats, and said adapter means including a single ball check valve gravity shifted between said valve seats depending on the upright and inverted positions of the sprayer for valving off one of said passages when exposed to air in the container.

2. The sprayer according to claim 1, wherein said adapter means comprises an adapter body, said first passage including a dip tube mounted to said adapter body and a groove formed in said adapter body communicating with one of said valve seats and with said dip tube.

3. The sprayer according to claim 2, wherein said second passage extends within said adapter body between the other of said valve seats and one end of said adapter body in the vicinity of said mounting means.

4. The sprayer according to claim 2, wherein said adapter body comprises an elongated liner having a first section coupled to said pump body, an internal cylinder coaxial with a second section of said adapter body, said cylinder defining said adapter chamber and being coupled to a valve controlled inlet passage of said pump body, a first of said valve seats projecting into said adapter chamber from a wall of said cylinder, said adapter body further comprising a hollow insert element having a first section extending into said second section, said first section of said element supporting a second of said valve seats which projects into said adapter chamber.

5. The sprayer according to claim 4, wherein said first section of said liner has an internal longitudinal first groove forming together with said pump body a portion of said second passages, said first portion of said insert element having an external longitudinal second groove forming together with said liner another portion of said second passage and said cylinder having an external longitudinal third groove forming together with said first section of said insert element a portion of said first passage.

* * * * *